US005180050A

United States Patent [19]

Rada et al.

[11] Patent Number: 5,180,050

[45] Date of Patent: Jan. 19, 1993

[54] PUSHBUTTON ROTARY SWITCH

[75] Inventors: Mark Z. Rada; John W. Willis; John A. Eade; Charles E. Kidwell, all of Kokomo, Ind.

[73] Assignee: Delco Electronics Corporation, Kokomo, Ind.

[21] Appl. No.: 775,392

[22] Filed: Oct. 15, 1991

[51] Int. Cl.[5] ..... H01H 3/00; H01H 9/00

[52] U.S. Cl. ..... 200/329; 200/4; 200/293; 200/316; 200/336; 200/341; 200/564; 200/7; 200/11 R; 74/471 R; 74/10.27

[58] Field of Search ..... 200/564, 565, 566, 329, 200/336, 341, 345, 511, 5 R, 5 B, 293, 316, 43.11, 43.13, 4, 502, 61.39, 61.54, 61.58 R, 6 R, 7, 11 R, 14; 74/471 R, 475, 10.27, 553, 554, 555

[56] References Cited

U.S. PATENT DOCUMENTS

| | | | |
|---|---|---|---|
| 2,576,836 | 11/1951 | Hilsinger, Jr. | 200/4 |
| 2,630,502 | 3/1953 | Hept | 200/5 R |
| 3,027,441 | 3/1962 | Mullen et al. | 200/316 |
| 3,952,176 | 4/1976 | Holder et al. | 200/11 |
| 3,983,348 | 9/1976 | Kellogg | 200/314 |
| 4,000,382 | 12/1976 | Kolb | 200/572 X |
| 4,164,633 | 8/1979 | Sheridan et al. | 200/4 |
| 4,175,221 | 11/1979 | Kellogg | 200/4 |
| 4,176,265 | 11/1979 | Mobus et al. | 200/316 |
| 4,186,284 | 1/1980 | Strachan | 200/4 X |
| 4,246,453 | 1/1981 | Marchese et al. | 200/565 X |
| 4,264,799 | 4/1981 | Aspden | 200/316 X |
| 4,518,832 | 5/1985 | Geremia | 200/4 |
| 4,724,286 | 2/1988 | Cummins | 200/4 |
| 4,868,352 | 9/1989 | Botz et al. | 200/4 |
| 4,894,492 | 1/1990 | Palumbo | 200/4 X |

*Primary Examiner*—Henry J. Recla
*Assistant Examiner*—Glenn T. Barrett
*Attorney, Agent, or Firm*—Mark A. Navarre

[57] ABSTRACT

A switch actuator mounted in a housing for axial and rotary movement operates a rotary switch on the actuator axis through an axial lost motion connection. A pushbutton switch offset from the axis is engaged by a semi-circular plate radially extending from the actuator and is actuated upon axial movement of the actuator for any rotary position of the actuator. Optionally, the plate has apertures which register with the pushbutton switch at selected actuator rotary positions to disable pushbutton operation at the selected positions. The actuator is made of light conducting transparent plastic to illuminate an indicator on the switch knob from a bulb within the housing. A flexible detent finger integrally molded into the housing engages the plate during its axial movement to impart tactile feel.

10 Claims, 2 Drawing Sheets

FIG 1
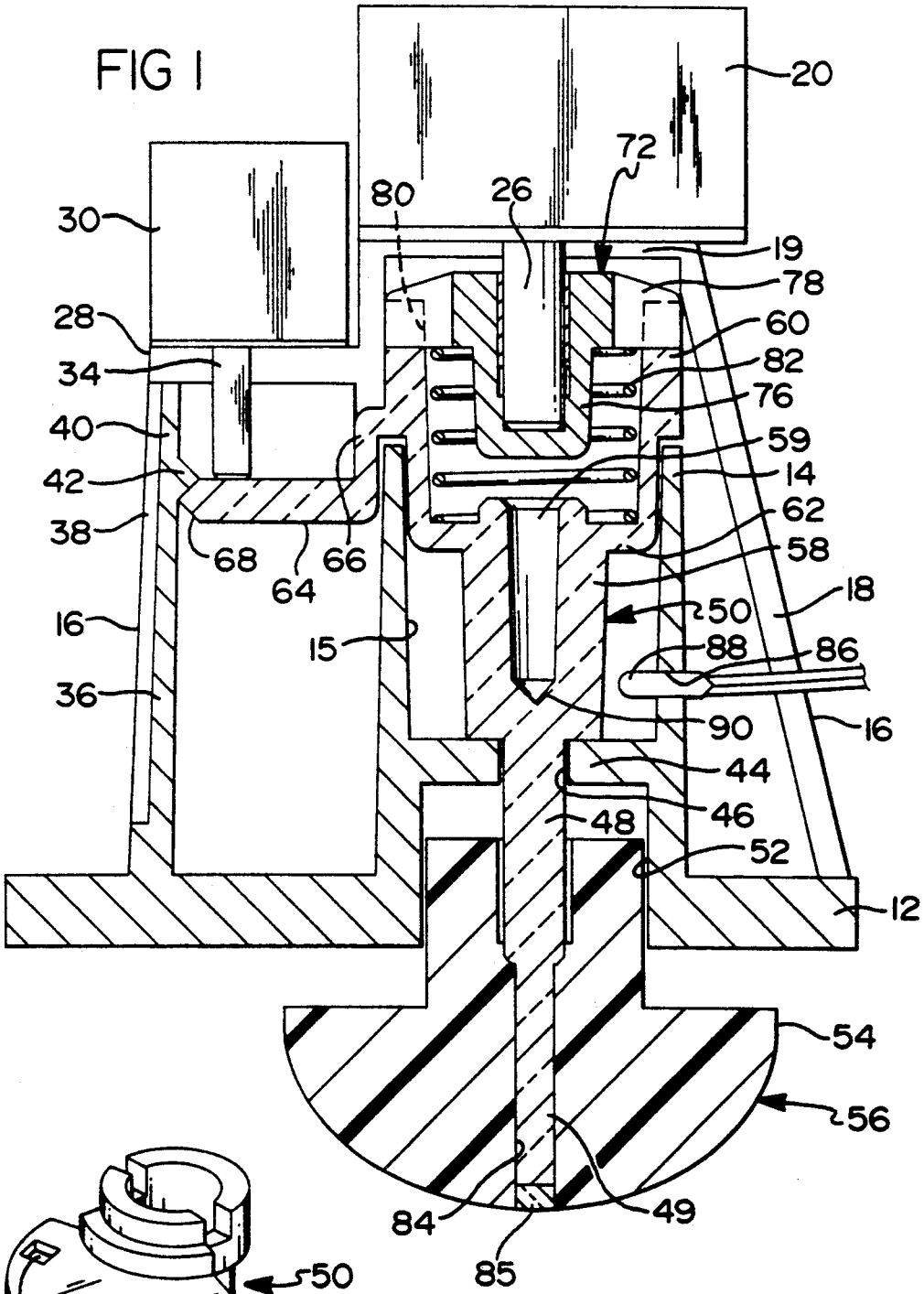
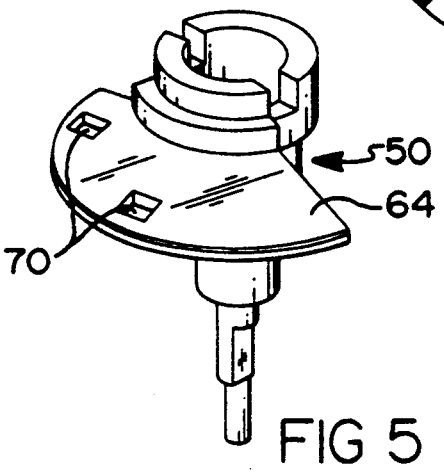
FIG 5

PUSHBUTTON ROTARY SWITCH

FIELD OF THE INVENTION

This invention relates to electrical switches and particularly to a switch assembly employing rotary and pushbutton operation for different functions.

BACKGROUND OF THE INVENTION

Many applications, such as automotive instrument panels, employ a number of switches to control various functions and only a limited space is available to accommodate all the switches. By combining two functions in a single switch assembly, the space can be utilized more efficiently. The mode switch for heating and air conditioning, and the fan switch, each are high current rotary switches, rated up to 25 amps. Momentary contact pushbutton switches for functions like controlling the rear defog, are low current devices. It is desirable to combine the functions in a single switch device to provide high current rotary switching and momentary on-off functions accessible at any rotary position.

SUMMARY OF THE INVENTION

It is therefore an object of the invention to provide an improved switch assembly having combined rotary and pushbutton functions. The switch assembly of this invention includes an actuator mounted in a housing for axial and rotary movement and operates a rotary switch on the actuator axis through an axial lost motion connection. A pushbutton switch offset from the axis is engaged by a semi-circular plate radially extending from the actuator and is actuated upon axial movement of the actuator for any rotary position of the actuator.

Optionally, the plate has apertures which register with the pushbutton switch at selected actuator rotary positions to disable pushbutton operation at the selected positions. The actuator is made of light conducting transparent plastic to illuminate an indicator on the switch knob from a bulb within the housing. A flexible detent finger integrally molded into the housing engages the plate during its axial movement to impart tactile feel.

BRIEF DESCRIPTION OF THE DRAWINGS

The above and other advantages of the invention will become more apparent from the following description taken in conjunction with the accompanying drawings wherein like references refer to like parts.

FIG. 1 is a cross-sectional view of a switch assembly according to the invention.

FIG. 5 is a view of an alternate embodiment of the switch actuator of FIG. 1.

DESCRIPTION OF THE INVENTION

Figure 2:
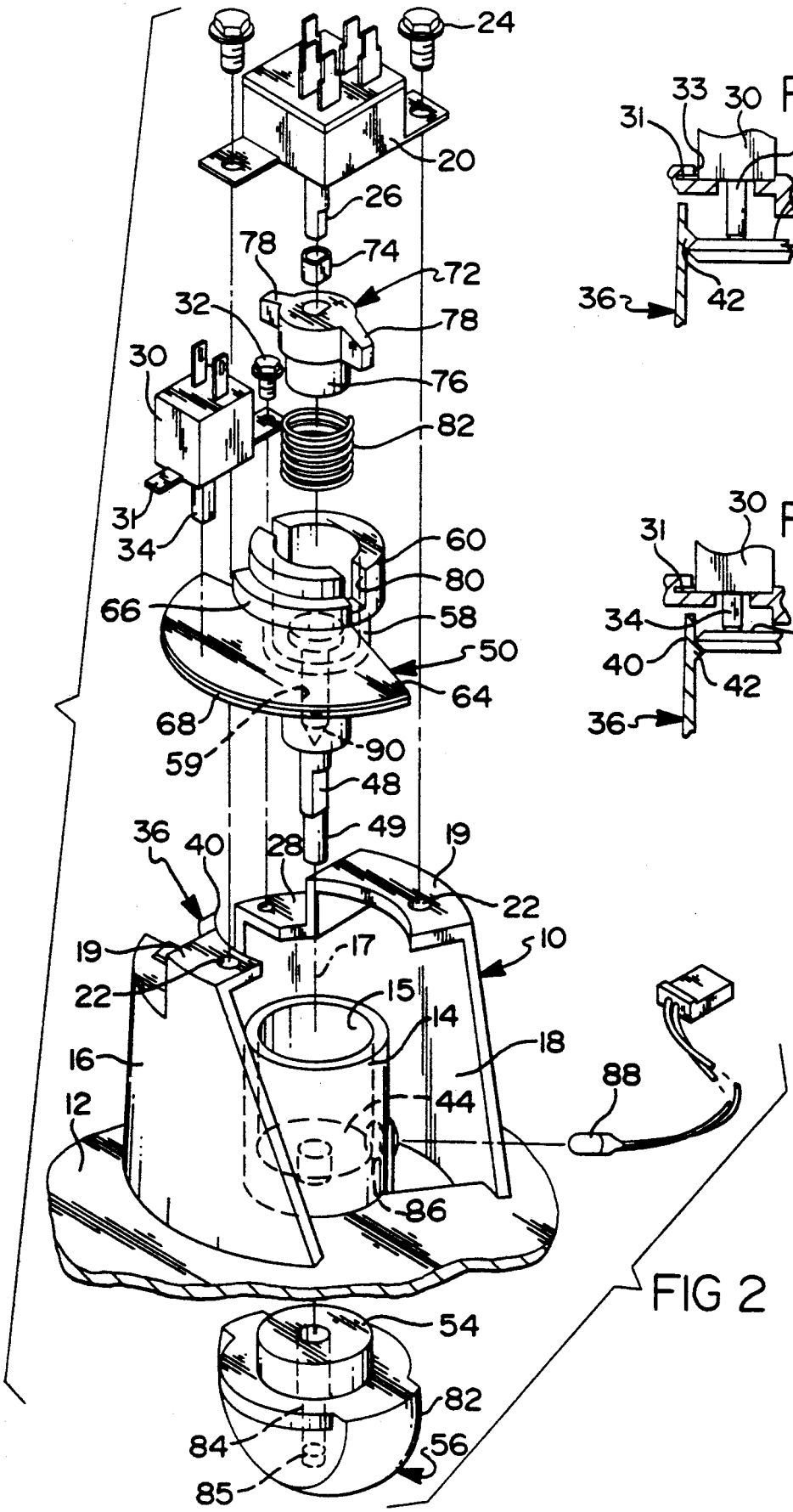
FIG. 2 is an exploded view of the switch assembly of FIG. 1.

Referring to FIGS. 1 and 2 of the drawings, a switch assembly according to the invention includes a molded polymer housing 10 comprising a front wall 12, an inner tubular portion 14 defining a bore 15 and an outer tubular wall 16 concentric with the inner tubular portion, the tubular elements having a common axis 17. The outer wall 16 is incomplete in that it has an open side 18. The end of the wall 16 opposite the front wall 12 supports inwardly turned flanges 19 for mounting a rotary switch 20, each flange containing an aperture 22 for receiving a screw fastener 24 to secure the switch 20. The apertures 22 are diametrically opposed relative to the axis 17 of the tubular elements so that the switch 20 is mounted with its shaft 26 located on the axis 17.

Figure 3:
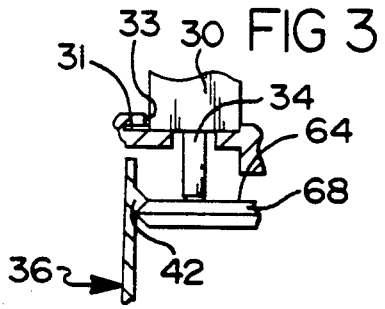
FIGS. 3 and 4 are details of a pushbutton switch and detent of FIG. 1 in normal position and actuated position, respectively.

The housing 10 further includes, on tubular outer wall 16 opposite the open side 18, a pair of spaced inwardly turned flanges 28 in a plane closer to the front wall 12 than the flanges 19 for supporting a pushbutton switch 30 which is secured at one side by a screw fastener 32. A tab 31 extending laterally from the other side of the switch 30 engages a cooperating slot 33 in one of the flanges 28, as seen in FIG. 3.

The pushbutton switch 30 is spaced from the axis 17 and has an elongated actuating button 34 extending between the flanges 28 into the housing 10 in a direction parallel to and laterally offset from the axis 17. The outer wall 16 includes an integrally molded flexible detent finger 36 which is defined by axial slots 38 in the wall 16 and has a substantially thinner cross section than the rest of the wall 16. The free end 40 of the detent finger 36 terminates short of the flanges 28 and carries an inwardly projecting triangular nib 42.

The inner tubular portion 14 contains a web 44 near the front wall 12 and a central bore 46 is provided in the web to receive the stem 48 of an actuator 50. An axial recess 52 in the front wall 12 is provided to receive a hollow shank 54 of a knob 56. Sufficient clearance is provided between the recess 52 and the shank 54 to allow axial movement of the knob 56 for pushbutton operation.

The actuator 50 is molded from a transparent light conduction polymer, such as acrylic or polycarbonate material. The actuator includes the stem 48, a rod-like tip 49 extending beyond the stem 48, a hollow body portion 58 defining a recess 59 disposed inboard of the stem 48, a tubular end portion 60 attached to the inboard end of the body portion 58 by a radial flange 62, and a semi-circular plate 64 which extends radially outwardly almost to the inner surface of the outer tubular wall 16. The plate surface is normal to the axis 17. A semi-cylindrical hub 66 attaches the plate 64 to the end portion 60 to position the plate 64 radially outboard of the end of the inner tubular portion 14. The stem 48 and the end portion 60 of the actuator 50 are supported by the bore 46 and the bore 15, respectively, for rotary and axial motion for the actuation of the rotary switch 20 and the pushbutton switch 30.

The pushbutton switch 30 is actuated by the plate 64 which engages the button 34 of the switch 30 and moves the button 34 axially when the actuator 50 is axially translated within the housing 10, but the button 34 is not engaged by plate 64 when plate 64 is in the normal position. The plate 64 is contoured with beveled edges at its outer periphery to form a wedge-shaped edge 68. As the actuator 50 moves axially, the edge 68 of the plate 64 engages the nib 42 of the detent finger 40 thereby causing outward flexing of the finger 40 and imparting tactile feel to the actuator motion, both when the button 34 is depressed and when it is released. The detent finger 40 and the nib 42 do not prevent return of the actuator to the normal position when the button is released.

Figure 4:
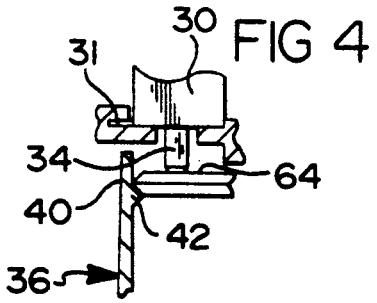

FIGS. 3 and 4 show the normal position and the actuated position, respectively, of the plate 64. The arcuate extent of the plate 64 is large enough so that when the actuator 50 is rotated to operate the switch 20, some portion of the plate 64 will engage the button 34 so that the switch 30 can be actuated for any rotary position of the switch 20. As shown in the drawings, the plate 64 extends over an angle of about 180 degrees which roughly corresponds to the rotary range of the switch 20.

It is feasible to design the actuator 50 so that the pushbutton switch 30 is operable at only certain positions of the rotary switch 20. As shown in FIG. 5, the plate 64 may be provided with apertures 70 that register with the button 34 for certain angular positions of the rotary switch 20, thereby preventing operation of switch 30 at those positions.

A lost motion connection between the actuator 50 and the rotary switch 20 for allowing the axial motion of the actuator 50 comprises a key 72 secured to the shaft 26 of the switch 20 via a flat spring 74, a key hub 76 extending into the tubular end 60 of the actuator 50, two diametrically opposite tabs or ears 78 extending radially outward from the key 72, a pair of slots 80 in the tubular end 60 of the actuator for receiving the tabs 78, and a compression spring 82 surrounding the hub 76 and trapped between the tabs 78 and the radial flange 62 to urge the actuator toward its normal outer position.

One tab 78 and its corresponding slot 80 are wider than the other tab and slot to polarize the key 72 relative to the actuator. The slots 80 are long enough to permit axial movement of the actuator 50 for operation of the pushbutton switch 30. Rotation of the actuator 50 causes rotation of the key 72 and the shaft 26 of the rotary switch 20. The range of rotation and detent positions are determined by the internal structure of the switch 20 itself.

Manual rotation and axial movement are imparted through the knob 56. The hollow shank 54 fits over the stem 48 of the actuator 50, the hollow shank 54 and the stem 48 having cooperating flats to ensure positive rotation of the actuator 50 with the knob 56. The knob 56 has a central bore 84 for receiving the tip 49 of the transparent actuator stem 48. A transparent indicator 85 is formed in the knob 56 at the outer surface of the knob to receive light from the tip 49.

The external surface of the indicator 85 is textured to assure an evenly lit appearance of the indicator from various viewing angles. A small lateral hole 86 in the inner tubular portion 14 holds a small light bulb 88 adjacent the body 58 of the actuator. A conical reflector 90 molded into the body 58 at the terminus of the recess 59 directs light from the bulb 88 into the stem 48 and through the tip 49 to illuminate the indicator 85 when the bulb is lit.

The switch 20 is preferably a high current rotary switch which is commercially available and requires no special development for the intended application. Similarly, the pushbutton switch 30 is preferably a commercially available low current switch which makes momentary contact for energizing or releasing a latching relay. Beryllium copper contacts and terminals could replace the switch 30. While a specific application has been suggested above, many other applications are appropriate.

The embodiments of the invention in which an exclusive property or privilege is claimed are defined as follows:

1. A switch assembly operable by pushbutton and/or rotary input motion comprising: a housing having a bore defining an axis; actuator means mounted in the bore for rotary and axial movement;

a rotary switch mounted on the housing and aligned with the said axis;

means for rotatably coupling the actuator means and the rotary switch for actuation of the rotary switch upon rotation of the actuator means;

pushbutton switch means mounted on the housing and spaced laterally from the axis; and the actuator means including an integral radial extension reaching the pushbutton switch for actuation of the pushbutton switch upon axial translation of the actuator means.

2. The switch assembly as defined in claim 1 wherein the rotary switch assembly includes an actuation shaft aligned with said axis, and the means for rotatably coupling includes an axial lost motion device engaging the shaft for imparting rotation to the shaft.

3. The invention as defined in claim 1 wherein an operating knob is affixed to the actuator means for controllably moving the actuator means, the knob having a central opening and a transparent indicator on the knob in alignment with the opening;

lamp means secured to the housing adjacent to the actuator means; and the actuator means being transparent so as to conduct light from the lamp means, and having a tip extending into the central opening of the knob adjacent to the indicator for illuminating the indicator when the lamp means is lit.

4. A switch assembly operable by pushbutton and/or rotary input motion comprising:

a housing having a bore defining an axis;

actuator means mounted in the bore for rotary and axial movement;

a rotary switch mounted on the housing and aligned with the said axis;

means for rotatably coupling the actuator means and the rotary switch for actuation of the rotary switch upon rotation of the actuator means;

pushbutton switch means mounted on the housing laterally offset from the axis;

wherein the housing includes an end wall, and inner and outer concentric tubular portions extending from the end wall, the inner tubular portion defining the said bore and the outer tubular portion supporting said rotary switch and said pushbutton switch means; and the actuator means including a radial extension reaching the pushbutton switch for actuation of the pushbutton switch upon axial translation of the actuator means.

5. The switch assembly as defined ion claim 4 wherein the outer concentric tubular portion has a flexible detent finger which engages the radial extension of said actuator means to impart tactile feel to the actuator means upon axial translation thereof.

6. The switch assembly as defined in claim 4 wherein the radial extension of the actuator means comprises a partial plate normal to the axis for actuation of the pushbutton switch means for every rotary position of the actuator means.

7. A switch assembly operable by selective pushbutton and rotary input motion comprising:

a housing having a bore defining an axis; actuator means mounted in the bore for rotary and axial movement;

a rotary switch mounted on the housing and aligned with the said axis;

means for rotatably coupling the actuator means and the rotary switch for actuation of the rotary switch upon rotation of the actuator means;

pushbutton switch means mounted on the housing at a location laterally offset from the axis; and the actuator means including a radial extension reaching the pushbutton switch for actuation of the pushbutton switch upon axial translation of the actuator means, wherein the radial extension of the actuator means comprises a partial plate normal to the axis for actuation of the pushbutton switch means for selected rotary position of the actuator means.

8. A switch assembly operable by pushbutton and/or rotary input motion comprising:

a housing having a bore defining an axis; actuator means mounted in the bore for rotary and axial movement;

a rotary switch mounted on the housing and aligned with the said axis, and including an actuation shaft aligned with said axis;

means for rotatably coupling the actuator means and the rotary switch for actuation of the rotary switch upon rotation of the actuator means including an axial lost motion device engaging the shaft for imparting rotation to the shaft;

pushbutton switch means mounted on the housing at a location laterally offset from the axis; and the actuator means including a radial extension reaching the pushbutton switch for actuation of the pushbutton switch upon axial translation of the actuator means;

wherein the axial lost motion device comprises:

a tubular end portion on the actuator means proximate to the rotary switch and concentric with the shaft; and key means axially slidable in the tubular end portion and drivingly attached to the actuation shaft and to the tubular end portion for transmitting rotary motion from the actuator means to the actuation shaft.

9. The switch assembly as defined in claim 8 wherein the key means has outwardly extending tabs for engaging the tubular end portion of said actuator means, and the tubular end portion defines slots for slidably receiving said tabs.

10. The switch assembly as defined in claim 8 wherein the key means is fixed to the rotary switch, and a compression spring fits within the tubular end portion and bears against the key means and the actuator means to axially bias the actuator means in a direction away from the rotary switch.

* * * * *